United States Patent [19]

Goodinge

[11] 3,949,938

[45] Apr. 13, 1976

[54] FUEL ATOMIZERS

[75] Inventor: Mark Wallinger Goodinge, Brentwood, England

[73] Assignee: Plessey Handel und Investments A.G., Suz, Switzerland

[22] Filed: Feb. 12, 1975

[21] Appl. No.: 549,306

[30] Foreign Application Priority Data

Mar. 14, 1974 United Kingdom ..... 11407/74

[52] U.S. Cl. ..... 239/102; 239/533; 239/585

[51] Int. Cl.[2] ..... B05B 3/14; B05B 1/30

[58] Field of Search ..... 239/533, 584, 585, 102, 239/95, 4, 570, 571

[56] References Cited

UNITED STATES PATENTS

| | | | |
|---|---|---|---|
| 2,960,314 | 11/1960 | Bodine, Jr. | 239/102 |
| 3,073,529 | 1/1963 | Baker | 239/571 |
| 3,200,873 | 8/1965 | Young et al. | 239/102 |
| 3,243,122 | 3/1966 | Snaper | 239/102 |
| 3,738,578 | 6/1973 | Farrell | 239/585 |
| 3,746,257 | 7/1973 | Broad et al. | 239/102 |
| 3,865,312 | 2/1975 | Lombard et al. | 239/585 |

*Primary Examiner*—Lloyd L. King
*Attorney, Agent, or Firm*—Fleit & Jacobson

[57] ABSTRACT

A fuel injection system comprising a fuel injection nozzle having a fuel injection orifice, and a vibrator to produce atomization of the fuel injected by the nozzle, the nozzle being equipped at the inlet side of its nozzle orifice with a liquid retaining ball valve which is arranged to normally close the nozzle orifice and thus prevent the injection of fuel by the nozzle and which is adapted to move away from the nozzle orifice when the vibrator is activated and thus allow the injection of fuel by the nozzle, the valve being situated in a housing in the nozzle and the housing having an aperture at a position where the valve tends to move when the vibrator is activated, thereby to allow the fuel to enter the housing through this aperture and force the valve towards the nozzle orifice when the nozzle is not being vibrated. Usually, the fuel will be introduced into the housing by passing along the passage and through the small passages in the housing. The device enables good fuel atomization with swift fuel cut-off.

9 Claims, 6 Drawing Figures

FUEL ATOMIZERS

This invention relates to a modification of or an improvement in the invention described in our U.S. Pat. No. 3,884,417. More specifically, this invention relates to a fuel injection system having an improved liquid-retaining valve for preventing fuel from being injected by a fuel injection nozzle at times when the nozzle is not being vibrated.

In our said U.S. Patent, there is described a fuel injection system in which a liquid-retaining valve, preferably a ball-type non-return valve, is arranged to normally close the nozzle orifice of a fuel injection nozzle and thus prevent the injection of fuel at times when the nozzle is not being vibrated by a vibrator.

We have now found that an advantageous construction of fuel injection nozzle is such that the valve is retained within a housing provided in the nozzle. With such an arrangement, if a floating (i.e., freely movable) valve is employed, there may be a tendency for the valve to remain on a wall of the housing, usually the wall opposite the nozzle orifice, during times when the nozzle is vibrated. When vibration of the nozzle is arrested, the valve may still remain on the wall and it can sometimes be difficult to get the valve to move speedily back to its position at the nozzle orifice whereby it stops fuel from being ejected from the nozzle. This is thought to be caused by fuel inside the housing acting to press the valve against the wall and/or by air pressure from an engine passing into the nozzle housing through the nozzle orifice and acting on the valve. It is an aim of the present invention to prevent this valve sticking.

Accordingly, this invention provides a fuel injection system comprising a fuel injection nozzle having a fuel injection orifice, and a vibrator to produce atomization of the fuel injected by the nozzle, the nozzle being equipped at the inlet side of its nozzle orifice with a liquid-retaining valve which is arranged to normally close the nozzle orifice and thus prevent the injection of fuel by the nozzle and which is adapted to move away from the nozzle orifice when the vibrator is activated and thus allow the injection of fuel by the nozzle, the valve being situated in a housing in the nozzle and the housing having at least one aperture at a position where the valve will tend to move to when the vibrator is activated, thereby to allow fuel to enter the housing through this aperture and force the valve towards the nozzle orifice when the nozzle is not being vibrated.

Preferably, the valve is a ball valve although other constructions of valve may be employed providing they have an appropriately designed seat to sit upon. Usually the valve will be freely movable in the housing as indicated above. Also usually, the valve will be held on a valve seat forming part of the nozzle orifice solely by fuel pressure.

Preferably, the or each aperture for allowing fuel to act on the valve will be arranged directly opposite the nozzle orifice.

The housing will preferably be provided with passages which allow fuel to be introduced and to swirl in a circular fashion in the housing.

The vibrator may include a piezoelectric crystal arrangement. If desired, the opening of the valve by vibration may be arranged to be effected or assisted by magnetic action upon the valve, for example with the help of a solenoid coil which is energized during the desired periods of injection to cause the nozzle to vibrate. In this case, the valve may be made wholly or partly of magnetic material and may be so arranged as to be urged in a direction away from its seat by the magnetic action of the energised solenoid.

In order to further facilitate optional atomization of the fuel leaving the nozzle, the downstream end portion of the nozzle may be provided with an inwardly projecting annular shoulder defining a sharp-edged opening.

The fuel injection system of the present invention may include a fuel feed device for providing a flow of fuel to the nozzle. The system may also include a timing control device which limits the energization of the nozzle vibrations, e.g. ultrasonic vibrations to uniformly spaced periods. Each timing period may constitute an adjustable part of a cycle related to the revolution of an engine. The fuel injection system may be used to inject fuel directly into (or more usually into the air intake conduit of) a two or four stroke internal combustion engine, a central heating boiler or a gas turbine.

When the fuel injection nozzle is vibrated, it will usually be vibrated with so-called "ultrasonic vibrations" or at so-called "ultrasonic frequency." These vibrations are obviously sufficient to cause the fuel to disintegrate into small mist-like particles. The frequency range in question may in practice be found to have its lower limit somewhere near the upper limit of audibility to a human ear. However, for reasons of noise suppression, it is generally preferable in practice to use frequencies high enough to ensure that audible sound is not produced.

Embodiments of the invention will now be described with reference to the accompanying drawings, in which.

Figure 1:
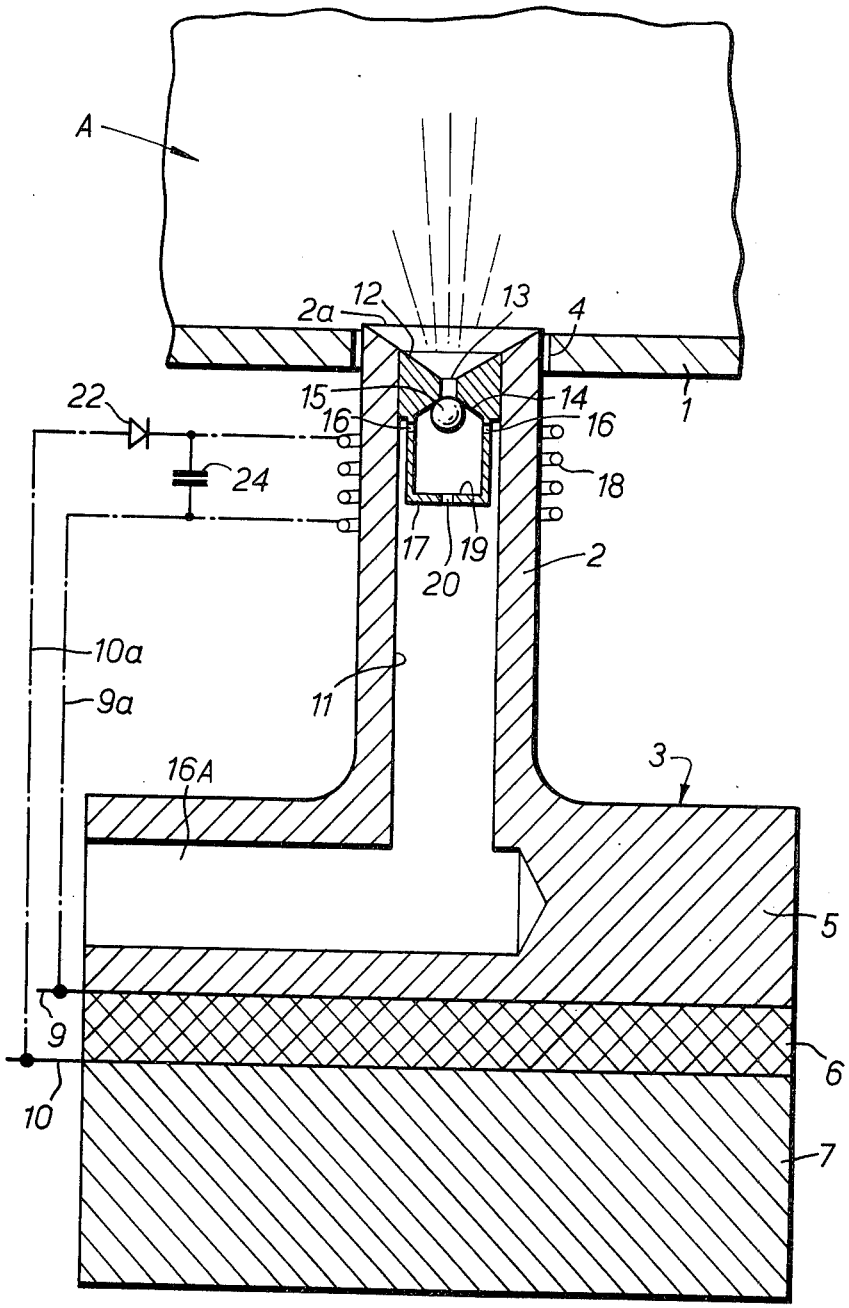
FIG. 1 is a somewhat diagrammatic axial section of one embodiment of a fuel injection system according to the present invention.

Referring to FIG. 1, there is shown a passage 1 which may be an induction line of an internal-combustion engine or, for example, a passage leading from the air compressor unto to the burners of a turbojet engine or other gas-turbine engine. In order to inject liquid fuel into the combustion air which may be assumed to pass through the line 1 in the direction of arrow A, a cylindrical nozzle portion 2 of a fuel injection nozzle or atomizer 3 is arranged to project with its end 2*a* through an aperture 4 in the wall of the passage 1. The fuel injection nozzle 3 projects in such a manner as to provide substantially sealing operation while permitting movement in the longitudinal direction of the portion 2.

The cylindrical portion 2 forms a so-called horn at one side of the large diameter portion 5 of a resonant stepped vibration amplifier. Attached at the opposite surface of the portion 5 is a vibrator in the form of a piezoelectric transducer element 6. A balancing body 7 is attached to the opposite side of the transducer element 6 as shown.

The arrangement is such that when an alternating voltage of a given ultrasonic frequency is applied to the piezoelectric element 6 by means of wires 9 and 10, resonant ultrasonic vibrations in the longitudinal direction of the cylindrical horn portion 2 are applied to the large diameter portion 5 of the vibration amplifier. The amplitude of the vibrations is magnified in the horn portion 2 which is so dimensioned that the maximum amplitude of oscillations is generated near the outer end 2*a* of the horn, which projects into the duct 1.

Arranged coaxially in the cylindrical horn portion 2 is a fuel passage 11. In order to provide a spray nozzle, this passage 11 is formed near the end 2*a* of the horn portion 2 with a restricted throat or inwardly projecting shoulder portion 12 which defines a nozzle orifice 13. The portion 12 is formed with a conical valve seat surface 14 which co-operates with a ball valve element 15. The ball valve 15 is freely removable.

Liquid fuel under suitable pressure is admitted to the passage 11 by a transverse bore 16A formed in the portion 5 of the vibration amplifier body.

Figure 2:
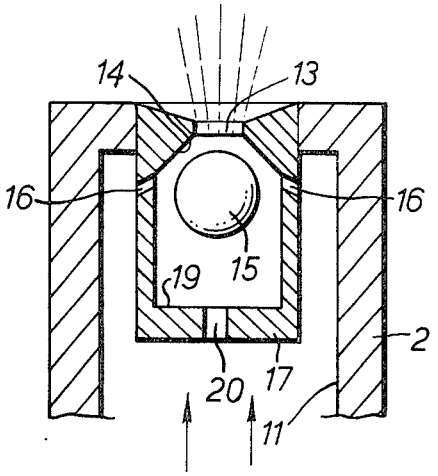
FIG. 2 is a detailed cross-section through a nozzle tip and is somewhat similar to the nozzle tip shown in FIG. 1.

It will be seen that a housing 17 surrounds the ball valve 15 and fuel from the passage 11 is allowed to enter the inside of this housing mainly by means of radial slots 16 shown most clearly in FIG. 2. Referring jointly to FIGS. 1 and 2, the slots or passages 16 communicate with the inside of the housing 17 and are preferably arranged, e.g. tangentially arranged, so that the fuel introduced to the inside of the housing 17 is caused to swirl. This fuel swirlage can assist in the atomization of the fuel.

The fuel injection system as so far described operates as follows. Usually, the fuel in the passage 11 and inside the housing 17 will cause the ball valve 15 to be held against the valve seal 14. This will normally prevent any fuel from leaving the fuel injection nozzle 3 through the orifice 13 and thus being injected into the flow of combustion air in the duct 1. When, however, an alternating voltage of the appropriate ultrasonic frequency is applied to the piezoelectric transducer element 6 by the wires 9 and 10, the resultant resonant vibration of the end portion 2*a* of the cylindrical horn 2 will produce dynamic forces upon the ball valve element 15. The valve 15 will be lifted off its seat 14 thus permitting fuel from within the housing 17 to pass through the nozzle orifice 13 into the duct 1. There will thus be produced in the duct 1, while the ultrasonic vibrations take place, a spray of atomized fuel which becomes intimately mixed with the flow of combustion air in the duct 1. This will thus produce a desired fuel and air mixture so long as the ultrasonic frequency is applied to the piezoelectric transducer element 6.

Now whilst the injection nozzle is being vibrated, the ball valve 15 will often take up a position adjacent the back face 19 of the rear wall of the housing 17. The ball may remain in this position even when the vibration is arrested if the rear wall is not provided with an aperture.

In the embodiments illustrated in FIGS. 1 and 2, it will be seen that the rear wall of the housing 17 is provided with an aperture 20 at the place where the valve 15 tends to move when the piezoelectric transducer element 6 is activated. This aperture 20 allows fuel from the passage 11 to enter the housing 17. Thus, as soon as the application of the ultrasonic frequency voltage ceases, fuel in the aperture 20 presses on the valve 15 and causes it to move towards the valve seat 14. Once the valve 15 is on its seat 14, then fuel injection by the nozzle 3 will be stopped and the pressure of the fuel in the passage 11 and housing 17 will cause the valve 15 to remain on its seat.

The embodiment illustrated in FIG. 1 also shows other means by which the ball valve 15 can be lifted off its seat 14 during the periods in which injection is desired, and which do not rely on the dynamic action of ultrasonic vibrations of the nozzle 3. Although the means can be used independently, they are used in the illustrated embodiment to increase the rate of flow permitted by the ball valve 15 above the rate achieved when inertia action due to the vibration is exclusively relied upon. These additional means comprise a solenoid winding 18 arranged around the cylindrical horn portion 2 at a suitable axial position. The cylindrical horn portion 2 is made of non-magnetic material, while the valve 15 consists of a magnetized steel or other suitable magnetic material. The winding 18 is so positioned that the valve 15 will be lifted off its seat 14 by magnetic action when the solenoid winding 18 is energised. The energising current is preferably direct current since otherwise the cylindrical portion 2 should be made of a material having sufficiently low electrical conductivity to avoid undue screening action by induced currents.

Suitable means may be provided for the appropriate timing of the energising current pulses for the winding 18. In the illustrated embodiment, these pulses have been arranged to coincide with the pulses of ultrasonic frequency current applied to the piezoelectric element 6 by connecting the winding, by a rectifier arrangement 22, 24 across the wires 9, 10, as shown by chain-dotted connecting lines 9*a*, 10*a*.

Figure 3:
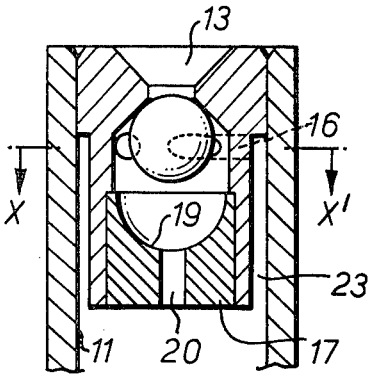
FIG. 3 is a detailed cross-section through a first alternative nozzle tip.
Figure 4:
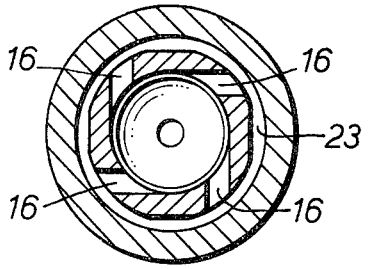
FIG. 4 is a section on the line X — X shown in FIG. 13.

Referring now to FIGS. 3 and 4, there is illustrated a first alternative construction of the nozzle tip. It will be seen that the housing 17 is still present but that the face 19 of the rear wall is curved. Also, the aperture 20 is formed in the rear wall 19 of the housing 17.

FIGS. 3 and 4 show four passages 16 arranged to tangentially enter the housing 17 to produce good fuel swirlage within the housing. The fuel in passage 11 reaches the passages 16 by passing along the annular gap 23 between the outside of the housing 17 and the wall of passage 11.

Figure 5:
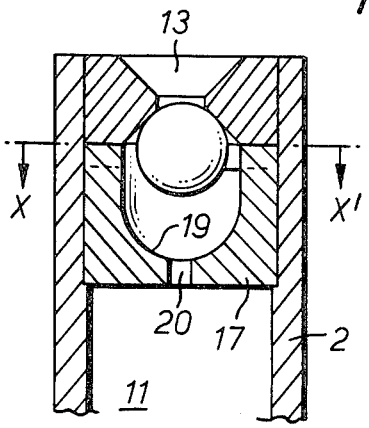
FIG. 5 is a detailed cross-section through a second alternative nozzle tip.
Figure 6:
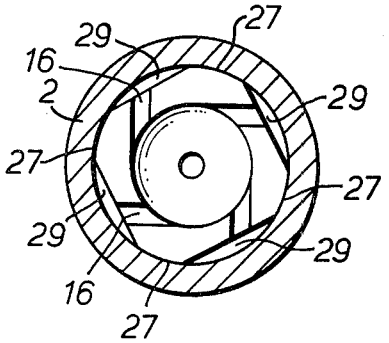
FIG. 6 is a section on the line X — X shown in FIG. 5.

Referring now to FIGS. 5 and 6, there is illustrated a second alternative construction of the nozzle tip. The construction is similar to that illustrated in FIGS. 3 and 4 and it will be seen that the housing 17 is present and the face 19 of the rear wall of the housing is curved. The aperture 20 is formed in the rear wall 19 of the housing 17.

FIGS. 5 and 6 show four passages 16 arranged to tangentially enter the housing 17 to produce good fuel swirlage within the housing. The outside of the housing 17 is connected as for example by brazing along its whole length at the four points 27 to the inside of the cylindrical nozzle portion 2. As shown most clearly in FIG. 6, there is then left four spaces 29 formed between the inside of the nozzle portion 2 and the outside of the housing 17 whereby fuel can pass up the passage 11, then up the spaces 29 and into the passages 16. In an alternative construction, the housing 17 could initially substantially engage the inner surface of the nozzle portion 2 over its whole circumference and then longitudinal passageways could be drilled to enable fuel to pass from the passageway 11 to the passages 16.

It is to be appreciated that in the construction shown in FIGS. 5 and 6, the housing 17 is so rigidly fixed to the nozzle portion 2 that housing 17 and the nozzle portion 2 can be regarded as a single solid object. This can be advantageous during the ultrasonic vibration in that the housing 17 shows no tendency to vibrate or move relative to the nozzle portion 2 and better fuel atomization can be achieved because there is a quicker response by the ball valve 15 to the stopping and starting of the vibrations.

In addition to fixing the housing 17 along its length to the nozzle portion 2, there are several other factors which may affect the atomization of the fuel from the nozzle portion 2. Firstly, the amount of fuel atomization achieved may be increased if the nozzle portion 2 is vibrated for an increased length of time.

Secondly, the amount of fuel atomization achieved from the nozzle portion 2 may be increased if the number of vibrations per constant length of time is increased.

Thirdly, size and mass of the ball valve 15 is operative to affect the fuel atomization achieved.

Fourthly, the number and location of the passageways 16 and the size of the housing 17 is operative to affect the fuel atomization achieved.

Fifthly, the internal shape of the housing 17 may be used to affect the fuel atomization. For example in FIGS. 1 to 6, the part of the housing 17 adjacent the orifice 13 is tapered towards the orifice. This means that any engine gases passing from the passage 1 through the orifice 13 can act with increasing pressure on the ball valve 15 to force it towards the aperture 20. In a similar manner, if the back wall of the housing 17 is tapered towards the aperture 20, then fuel passing along the passage 11 and through the aperture 20 can act on the ball valve 15 when it is adjacent the aperture 20 with increasing force to propel it towards the orifice 13. Also, the size of the aperture 20 may be used to determine the amount by which the valve 15 leaves its seat 14 during vibration. This will obviously affect the flow rate of fuel from the nozzle 3. The size of the aperture 20 may also be used to control the speed and consistency with which the valve 15 returns to its seat 14 when the vibration is stopped.

It is to be understood that the embodiment of the invention described above with reference to the accompanying drawings have been given by way of example only. Thus, the described solenoid arrangement may be modified in various ways so that a non-magnetic valve element may be combined with a magnetic armature connected to it for common movement. A spring may be employed in the housing 17 to assist the fuel passing through the aperture 20 in rapidly returning the ball valve 15 to its seat 14 when the vibration is stopped. Also, with a ball valve 15 which is large compared with the housing 17, the aperture 20 may act to allow fuel in the housing 17 to be vented through the aperture 20 to the passage 11 at the instant when the vibration is started and the ball valve 15 moves off its seat 14 and towards the aperture 20.

What is claimed is:

1. A fuel injection system comprising a fuel injection nozzle having a fuel injection orifice, and a vibrator to produce atomization of the fuel injected by the nozzle, the nozzle being equipped at the inlet side of its nozzle orifice with a liquid-retaining valve which is arranged to normally close the nozzle orifice and thus prevent the injection of fuel by the nozzle and which is adapted to move away from the nozzle orifice when the vibrator is activated and thus allow the injection of fuel by the nozzle, the valve being situated in a housing in the nozzle and the housing having at least one aperture at a position where the valve will tend to move to when the vibrator is activated, thereby to allow fuel to enter the housing through this aperture and force the valve towards the nozzle orifice when the nozzle is not being vibrated.

2. A fuel injection system according to claim 1, in which the valve is a ball valve.

3. A fuel injection system according to claim 2 in which the ball valve is held on a valve seat forming part of the nozzle orifice solely by fuel pressure.

4. A fuel injection system as claimed in claim 1, in which there is one aperture and this aperture is directly opposite the nozzle orifice.

5. A fuel injection system as claimed in claim 1, in which the housing is provided with passages which allow fuel to be introduced and to swirl in a circular fashion in the housing.

6. A fuel injection system as claimed in claim 1, in which the vibrator includes a piezoelectric crystal arrangement.

7. A fuel injection system according to claim 1 including a fuel feed device for providing a flow of fuel to the nozzle.

8. A fuel injection system according to claim 7 including a timing control device which limits the energisation of the nozzle vibrations to uniformly spaced periods.

9. A fuel injection system according to claim 4 in which the housing is joined to the nozzle along its longitudinal length.

* * * * *